United States Patent [19]

Felix

[11] Patent Number: 4,794,802

[45] Date of Patent: Jan. 3, 1989

[54] PROCESS AND APPARATUS FOR MEASURING THE WARP TENSION IN LOOMS AND THE LIKE

[75] Inventor: Ernst Felix, Uster, Switzerland

[73] Assignee: Zellweger Uster Ltd., Uster, Switzerland

[21] Appl. No.: 44,365

[22] PCT Filed: Aug. 27, 1985

[86] PCT No.: PCT/CH85/00125

§ 371 Date: Mar. 24, 1987

§ 102(e) Date: Mar. 24, 1987

[87] PCT Pub. No.: WO87/00562

PCT Pub. Date: Jan. 29, 1987

[30] Foreign Application Priority Data

Jul. 26, 1985 [CH] Switzerland ..... 03255/85

[51] Int. Cl.[4] ..... G01L 5/10; G01B 17/00

[52] U.S. Cl. ..... 73/862.41

[58] Field of Search ..... 73/862.41, 862.46, 580, 73/581, 778, DIG. 1, 159, 160

[56] References Cited

U.S. PATENT DOCUMENTS

| | | | |
|---|---|---|---|
| 2,923,150 | 2/1960 | Imboden et al. | 73/862.41 |
| 3,040,565 | 6/1962 | Church et al. | 73/581 X |
| 3,802,467 | 4/1974 | Steverlynck . | |
| 3,916,687 | 11/1975 | Loepfe et al. . | |

FOREIGN PATENT DOCUMENTS

| | | | |
|---|---|---|---|
| 901112 | 3/1985 | Belgium . | |
| 1540535 | 9/1968 | France . | |
| 391388 | 7/1973 | U.S.S.R. | 73/862.41 |
| 446781 | 10/1974 | U.S.S.R. | 73/862.41 |
| 1084678 | 9/1967 | United Kingdom . | |

*Primary Examiner*—Charles A. Ruehl

*Attorney, Agent, or Firm*—Burns, Doane, Swecker & Mathis

[57] ABSTRACT

To measure the tension in a set of threads (10) or a warp (11) in a loom or the like, a vibrating device (20) which is rotatable about an axis (23) is moved into the vicinity of the web of material so that the material is thereby slightly deflected from its straight line course. The vibrating device (20) is set into oscillating movement by an excitation device (30). The frequency ($f_o$) at which the vibration of the device (20) becomes established is directly dependent upon the tension P in the group of threads or the fabric, and this tension can therefore be determined from the frequency $f_o$. The vibrating device (20) may also be set into its intrinsic vibration at an intrinsic frequency $f_o$ simply by the threads (10) or fabric (11) gliding over its surface (24), and this frequency can be measured by means of a sensor (34) and transducer (35). A particularly advantageous construction of the vibrating device (20) consists of a plate with a notch (26) lying on a knife edge (27). The intrinsic vibrations of the vibrating device (20) may be eliminated by equipping the vibrating device with a counterweight (25) which shifts the center of gravity of the system to the point of intersection of the lines of tension exerted by the set of threads or fabric.

23 Claims, 3 Drawing Sheets

PROCESS AND APPARATUS FOR MEASURING THE WARP TENSION IN LOOMS AND THE LIKE

Measurement of the warp tension in looms and the like is an essential factor for keeping the tension constant by means of warp tension regulators. A constant warp tension is essential for the production of a perfect weave. Processes and apparatus have therefore always been in use for measuring this warp tension and using the measurements as a basis for control parameters with which to activate devices for controlling the warp tension.

The earliest method of measuring the warp tension and converting it into a measuring signal uses a deflecting device operated by the force exerted by the whole warp, for example on the back rest. The disadvantage of measuring the whole warp tension lies mainly in the large masses which have to be moved but only produce a relatively small deflection of the spring mounted back rest. Another disadvantage is that the force measurement is produced by all the warp threads so that variations in the warp tension across the width of the warp are not detected.

Other processes and apparatus have been proposed in which the whole warp is deflected between two fixed points by means of a loaded roller or the like and the magnitude of the deflection is taken as a measure of the warp tension. Although such devices could in principle be used over separate portions of the warp, they invariably constitute an obstruction, especially for servicing and operating the loom. Moreover, none of the processes mentioned above has solved the problem of the so called zero point constancy.

Processes and apparatus recently proposed are based on setting the warp, preferably partially, into localized resonance vibrations, either by bringing an auxiliary mass into contact with a portion of the warp threads and causing this system to vibrate or by setting only the warp threads into vibration. In either case, the thread tension can be determined from the resulting resonance frequency and the known mass of the warp threads in accordance with the principle of the vibrating cord. The problem of zero point constancy is solved in this process.

Even these systems, however, are not free from disadvantages, at least with regard to the complicated structure and therefore high cost of such vibrating systems. The process fails when attempts are made to use if for measurements in the whole fabric since the weft threads are liable to vary in density.

The present invention relates to a process for measuring the warp tension either on the warp itself and/or in the fabric in textile machines and the like, characterised by the features given in claim 1.

The invention also covers an apparatus having the features given in claim 10 for carrying out the process.

Figure 1:
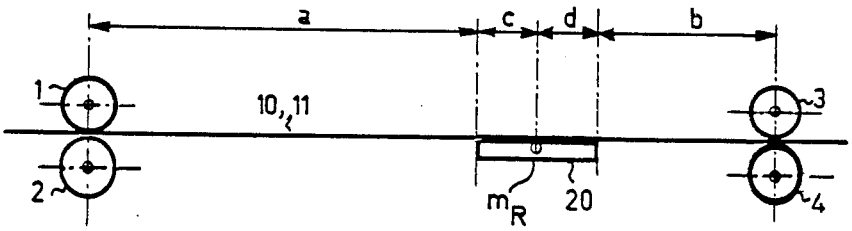
Figure 2:
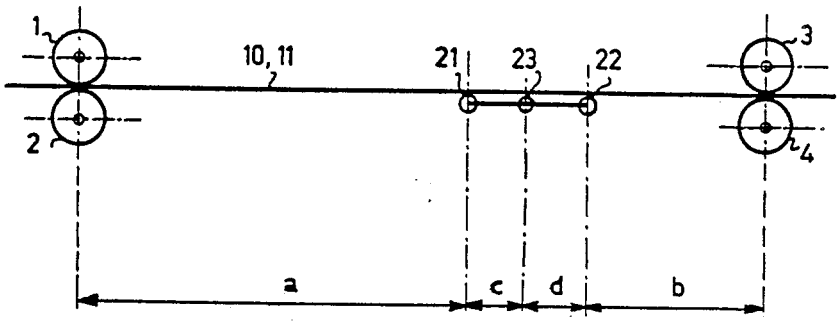
Figure 3:
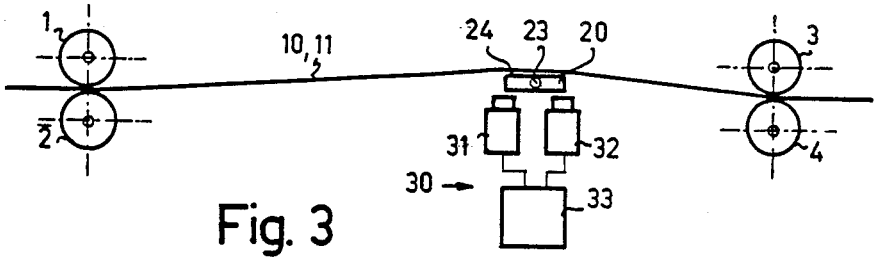
Figure 4:
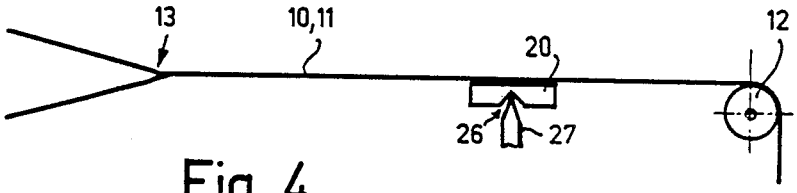
Figure 5:
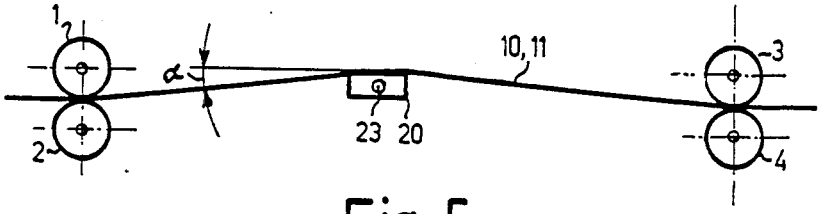
Figure 6:
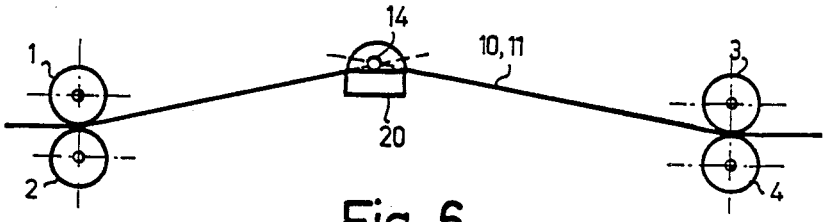
Figure 7:
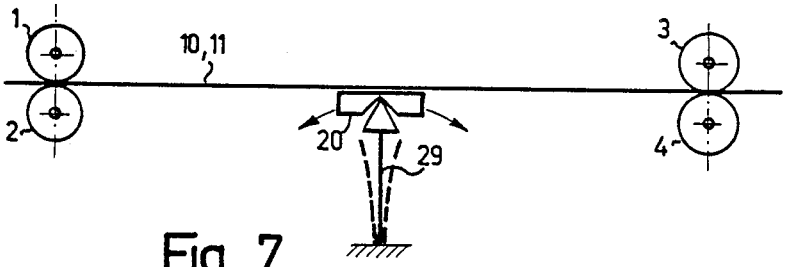
Figure 8:
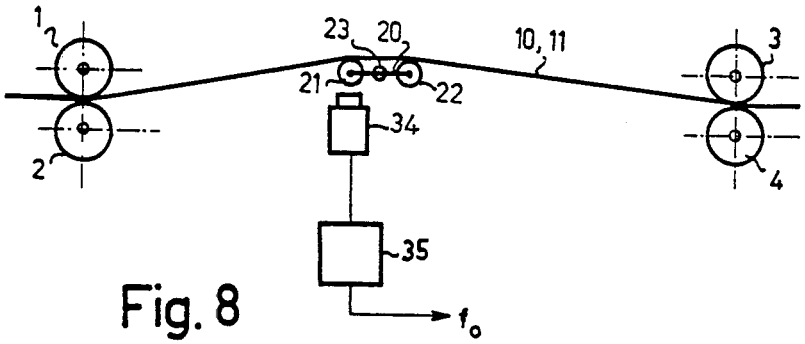
Figure 9:
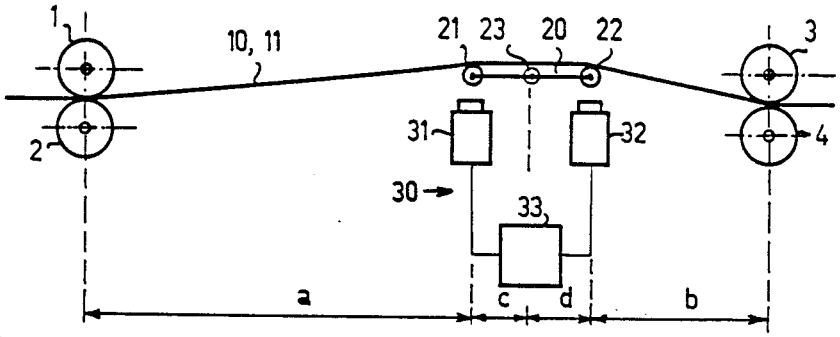
Figure 10:
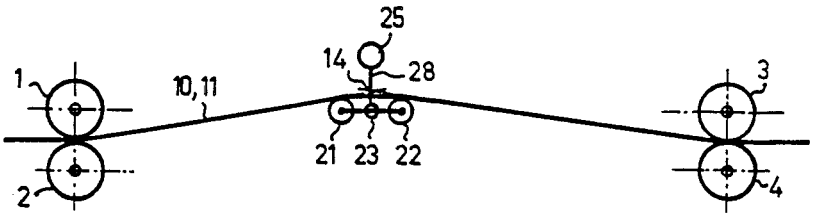

Exemplary embodiments of the invention will now be explained with the aid of the description and drawings, in which FIG. 1 is a first schematic representation of the principle of measurement, FIG. 2 shows the arrangment of the vibrating device and the warp, FIG. 3 is a schematic representation of a vibrating device with associated drive means, FIG. 4 shows schematically a vibrating device in relation to parts of the loom, FIG. 5 shows the geometrical relationships between the widths of cloth and the vibrating device, FIG. 6 is another representation of the geometric relationships, FIG. 7 represents a variation of the vibrating device, FIG. 8 shows schematically a vibrating device with sensor, FIG. 9 shows a vibrating device with selfexcitation and FIG. 10 shows a vibrating device with counter weight.

In the arrangement shown schematically in FIG. 1, the warp 10 whose tension is required to be measured or the woven cloth 11 is normally gripped between conveyor devices such as, for example, rear cylindrical rollers 1, 2 and front cylindrical rollers 3, 4. A vibrating device 20 is introduced between these two lines. This device executes a rotational vibration about its axis. It is capable of rotating about its axis but when there is a deflection from the straight line it produces a restoring force which is proportional to the deflection and to the tension.

The vibrating device 20 and the warp or cloth thus combine to form a resonance system operating at a resonance frequency defined by the formula:

$$\omega^2 = \frac{P\left(c + d + \frac{c^2}{a} + \frac{d^2}{b}\right)}{m_R} \tag{1}$$

where $\omega$=angular frequency of the vibrating device

P=tension in the warp or fabric, $m_R$=rotational moment of inertia of the vibrating device a=distance of left supporting line from the adjacent edge of vibrating device b=distance of right supporting line from the adjacent edge of vibrating device.

c, d=distances between rollers or edges of vibrating device and axis 23.

Formula (1) which can be derived mathematically shows that the tension can be determined from the resonance frequency.

Now that the basic idea of the invention has been explained, the construction shown schematically in FIG. 2 will be described. A vibrating device 20 mounted to be rotatable about a central axis 23 lies in contact with the warp 10 or web 11. The web is slightly deflected upwardly to ensure that the vibrating device will always remain in contact with it. In other words, the web (warp 10 or fabric 11) is under the influence of the tension P on the vibrating device 20.

The vibrating device 20 may consist of a rotatably mounted plate, and its surface of contact 24 with the web (10, 11) may advantageously be regarded as a wear resistant surface (FIG. 3). This method is suitable, for example, for weaving and finishing processes.

Instead of using cylindrical rollers, the warp or fabric may be supported by parts of the operating machine, such as the warp beam, back rest or breast beam of the loom or squeezing rollers, deflecting rollers of the sizing machine, etc.

In cases where a>c and b>d, formula (1) may be reduced to:

$$\omega^2 = \frac{P(c+d)}{m_R} \quad (2)$$

This property becomes particularly important when the vibrating device 20 is used in a part of the machine where the distance between the line of contact and the vibrating device is variable, e.g. in the case of deflecting rollers which are radially spring mounted in the sizing machine. One special case is the measurement of the tension of the material on the loom. The breast beam 12 (FIG. 4) is then an accurately defined surface of support. On the other side of the vibrating device, on the other hand, the fell of the cloth 13 forms an apparent point of support when the shed is open. The distance between the vibrating device and the selvedge, however, is also defined under these circumstances. When the shed is closed, on the other hand, the point of support extends into the harness. When the dimensions of the vibrating device are small in comparison to the distance of the vibrating device to the selvedge or to the harness, then the influence of this variable distance is negligible.

In that case, the variable factor a is several times greater than c, and the quotient (in formula (1)) makes only a negligible contribution to the sum $$\left(c + d + \frac{c^2}{a} + \frac{d^2}{b}\right).$$

The possibility of mounting the vibrating device 20 by means of a cutting blade 27 and a notch 26 in the vibrating device is shown in FIG. 4. The web 10, 11 in this case holds the vibrating device 20 firmly against the blade 27.

The vibrating device should have a substantially greater mass than the fabric. In that case, any difference in the weight of the fabric due to differences in the weft density do not interfere with the results.

To measure the tension P of the warp 10 or of the web of fabric 11, the vibrating device 20 is activated at its resonance frequency. Devices for activating mechanical vibrating structures are known. They generally consist of a drive member, a back coupling or feed back element and an amplifier. Thus, for example, an electro-mechanical activating device 30 shown in FIG. 3 can deflect the vibrating device 20 about its axis 23 by means of an electro-magnet. The feed back device may consist of known inductively, capacitatively, optically or pneumatically operating distance meters with amplifiers connected in series therewith. The device may comprise, for example, a driving coil 31 and a feed back coil 32 with amplifier 33. The vibrating device then automatically vibrates at the resonance frequency. The frequency $f_o$ at which the vibration of the device 20 becomes established is directly dependant upon the tension P of the web of fabric lying on the device 20 in accordance with formula (1).

Formula (1) is only applicable, however, when the deflecting angle $\alpha$ about the oscillating plate is very small and the center of rotation of the deflecting device is quite close to the fabric (FIG. 5). In other cases, the vibrating movement is no longer perpendicular to the plane of the fabric. If the warp 10 or fabric 11 adheres to the vibrating device due to friction then changes in length take place in section a and b and stretching forces are therefore produced in the warp or fabric. Additional forces therefore arise which depend on the magnitude of the deflection so that formula (1) is no longer valid and the measurement of force is no longer accurate.

This source of error can be eliminated by placing the center of rotation of the oscillating structure at the point of intersection 14 of the imaginary extensions of the lines of force along which the tension in the warp 10 or fabric 11 acts (FIG. 6). The vibrations are in that case exactly perpendicular to the plane of the fabric and the fabric undergoes virtually no change in length if the amplitudes of the vibrations are small.

The aforesaid changes in length may also be eliminated by enabling the center of rotation of the vibrating device to move in the direction of the fabric 10 or 11 instead of fixing its location. An example of this arrangement is shown in FIG. 7, in which the supporting blade 27 is a leaf spring 29 so that the center of rotation of the vibrating device can be deflected. The apparent center of rotation then again lies at the desired point of intersection of the forces of tension.

Alernatively, the center of rotation may be deliberately placed outside the point of intersection 14, as shown in FIG. 8, so that when the warp 10 or fabric 11 moves, vibrations are produced by frictional forces (which are exactly constant). The frequency of these vibrations is close to the resonance frequency. The vibrating system can therefore be set into vibration without the aid of an additional energizing system, and the frequency $f_o$ at which these vibrations become established may be determined from the frequency of the force P by means of a sensor 34 and a transducer 35.

The vibrating device 20 may have rotatably mounted rollers 21, 22 to keep the friction between the warp or fabric and the vibrating device 22 at a minimum (FIG. 9). This measure is advantageously used in sizing and finishing plants.

Formula (1) again is only accurate when the center of gravity of the oscillating structure lies at the center of rotation, i.e. in the longitudinal axis 23 (FIG. 10). The center of gravity of the oscillating structure consisting of vibrating device 20 and optionally its rollers 21, 22 may be moved into the center of rotation by placing a counterweight 25 on the line of symmetry 28 passing through the vibrating device 20.

If the center of gravity of the oscillating structure does not lie at the center of rotation then the system may vibrate as a pendulum, e.g. at zero force. The result then obtained, however, is only slightly falsified if the resonance frequency of the whole system and the frequency of oscillation of the empty pendulum lie far apart. Moreover, the frequency deviation is constant and can be calculated.

I claim:

1. Process for measuring the tension of a web of textile material such as a group of threads or a fabric, characterized in that a vibrating device (20) is provided in the region of and on one side only of the web of textile material whose tension is to be measured and the said web of textile material is moved over this vibrating device (20), in that the vibrating device (20) is set into vibrations by the web of textile material gliding over it, which vibrations are converted into electric signals of a frequency ($f_o$) by means of a sensor (34) and transducer (35), and in that the tension (P) of the web of textile material is determined from the resonance frequency ($f_o$) of the vibrating device (20).

2. Apparatus for measuring the tension of a group of threads or a fabric, characterized in that a vibrating device (20) is rotatably mounted about a central longitudinal axis (23) formed by a notch (26) and a knife edge (27), that the knife edge (27) is mounted at the end of a unilaterally fixed spring (29), that the group of threads (10) or the fabric (11) is in contact with and deflected from a straight line by the vibrating device (20) and that the vibrating device (20) can be set into movements of vibration about the aforesaid longitudinal axis (23).

3. A method for measuring the tension of a textile sheet such as a set of threads or a fabric in a textile machine, the said textile sheet being guided between first and second guiding means, said method comprising providing an oscillating device on one side only of said textile sheet, bringing the said device in contact with the said one side of said textile sheet, deflecting said textile sheet from a straight line path, and determining the tension of the textile sheet from the resonance frequency of the oscillating device.

4. A method according to claim 3, wherein said oscillating device (20) is set into oscillation about its longitudinal axis by means of a back coupled electromechanical activating device (30).

5. A method according to claim 4, wherein said textile sheet passes to and from said oscillating device along paths having directions which intersect with one another in the vicinity of said oscillating device and which extend at angles to a straight line between said first and second guiding means, and wherein the true or apparent center of rotation of the oscillating device (20) lies at least approximately at said point of intersection (14).

6. A method according to claim 3, wherein said textile sheet is moved over rollers (21, 22) which are mounted in the oscillating device (20).

7. A method according to claim 3, wherein said textile sheet is passed over a surface (24) of the oscillating device (20).

8. A method according to claim 3, wherein said oscillating device (20) is balanced by a counterweight (25).

9. A method according to claim 3, wherein the moving mass of said oscillating device (20) is large compared with the mass of the textile sheet between said first and second guiding means.

10. Apparatus for carrying out the method according to claim 3, characterized in that said oscillating device (20) is rotatably mounted about a central longitudinal axis (23), that the textile sheet is in contact with the oscillating device (20) and that the oscillating device (20) can be set into movements of oscillation about the aforesaid longitudinal axis (23).

11. Apparatus according to claim 10, characterized in that the textile sheet is deflected from a straight line by the oscillating device (20).

12. Apparatus according to claim 11, characterized in that the oscillating device (20) has rotatably mounted rollers (21, 22).

13. Apparatus according to claim 11, characterized in that the longitudinal axis (23) of the oscillating device (20) is formed by a notch (26) and knife edge (27).

14. Apparatus according to claim 13, characterized in that the knife edge (27) is mounted at the end of a unilaterally fixed spring (29).

15. Apparatus according to claim 11, characterized in that the oscillating device (20) has a wear resistant surface (24) facing the web of textile material.

16. Apparatus according to claim 10, characterized in that the oscillating device (20) has rotatably mounted rollers (21, 22).

17. Apparatus according to claim 10, characterized in that the longitudinal axis (23) of the oscillating device (20) is formed by a notch (26) and a knife edge (27).

18. Apparatus according to claim 17, characterized in that the knife edge (27) is mounted at the end of a unilaterally fixed spring (29).

19. Apparatus according to claim 10, characterized in that the oscillating device (20) is balanced about its longitudinal axis (23) by a counterweight (25).

20. Apparatus according to claim 10, characterized in that the oscillating device (20) is arranged in the region of an electro-mechanical activating device (30).

21. Apparatus according to claim 20, characterized in that the electro-mechanical activating device (30) has an oscillating coil (31), a back coupling coil (32) and an oscillator/amplifier (33).

22. Apparatus according to claim 10, characterized in that a sensor (34) with transducer (35) is associated with the oscillating device (20) whereby vibrations of the oscillating device (20), which has been activated by said textile sheet to vibrate in its own mode, are converted into electrical signals.

23. Apparatus for measuring the tension in a set of warp threads in a loom comprising first and second means spaced apart from one another and supporting said warp threads under tension in the space between said first means and said second means; means for moving said warp threads longitudinally through said space; an oscillatable thread contacting device mounted for oscillating motion about an axis extending transversely with respect to the direction from said first to said second means, said thread contacting device contacting said warp threads from one side only of said warp threads and at locations before and after said axis in the path of movement of said warp threads to deflect said warp threads from a straight path extending directly from said first means to said second means; and means for sensing oscillations of said oscillatable device about said axis and determining the frequency of vibration of said warp threads to provide a measure of the tension in said warp threads.

* * * * *